United States Patent [19]

Fenton

[11] 4,454,027

[45] Jun. 12, 1984

[54] ARSENIC REMOVAL METHOD

[75] Inventor: Donald M. Fenton, Anaheim

[73] Assignee: Union Oil Company of California, Los Angeles, Calif.

[21] Appl. No.: 408,078

[22] Filed: Aug. 16, 1982

[51] Int. Cl.[3] ..... C106 29/04

[52] U.S. Cl. ..... 208/253; 208/11 R

[58] Field of Search ..... 208/253, 251 R, 11 R

[56] References Cited

U.S. PATENT DOCUMENTS

| | | | |
|---|---|---|---|
| 2,779,715 | 1/1957 | Murray et al. | 196/50 |
| 3,034,979 | 5/1962 | Nevens | 208/8 R |
| 3,093,574 | 6/1963 | Bertolacini et al. | 208/91 |
| 3,542,669 | 11/1970 | DeFeo | 208/91 |
| 3,804,750 | 4/1974 | Myers et al. | 208/253 |
| 3,876,533 | 4/1975 | Myers | 208/88 |
| 3,954,603 | 5/1976 | Curtin | 208/253 |
| 4,001,105 | 1/1977 | Gifford | 208/11 R |
| 4,046,674 | 9/1977 | Young | 208/253 |
| 4,075,085 | 2/1978 | Young | 208/253 |
| 4,159,241 | 6/1979 | Simo | 208/251 H |
| 4,181,596 | 1/1980 | Tensen | 208/11 R |
| 4,246,093 | 1/1981 | Wolcott, Jr. | 208/8 R |

*Primary Examiner*—Delbert E. Gantz
*Assistant Examiner*—Anthony McFarlane
*Attorney, Agent, or Firm*—Dean Sandford; Gregory F. Wirzbicki; Robert A. Franks

[57] ABSTRACT

Aqueous and organic fluids which contain arsenic are contacted with spent oil shale from an oil shale retorting operation and separated therefrom, yielding a fluid of reduced arsenic content. In one embodiment, shale oil is placed in contact with spent oil shale under conditions of elevated temperature and pressure to reduce the arsenic content of the oil.

10 Claims, No Drawings

ARSENIC REMOVAL METHOD

BACKGROUND OF THE INVENTION

1. Field of the Invention

This invention relates to the removal of arsenic from fluid materials, including aqueous fluids and organic fluids such as oils.

2. Description of the Art

Vast deposits of oil shale, a sedimentary marlstone, are known to exist in various areas of the world. Such deposits are found in the United States, with the more commercially important materials located in the states of Colorado, Utah and Wyoming. The geologic unit known as the Green River formation in those states contains oil shale having up to about 35 percent by weight of hydrocarbons, in the form of kerogen. Upon heating the shale ("retorting"), kerogen decomposes to produce crude shale oil vapors, which can be condensed into a synthetic crude oil and subsequently introduced into a refinery for conversion to valuable fuels, lubricants and other products.

A number of retorting processes are known, generally classified in two categories: "in situ", wherein shale is heated in chambers formed underground without removing a significant portion of the rock material, and "above ground", wherein shale is mined by conventional methods and transported to a pyrolysis device for heating. The various processes each accomplish separation of solid and liquid retort products, using techniques which are specifically designed for the particular process.

One successful above ground retorting process is shown in U.S. Pat. No. 3,361,644 to Deering, which patent is incorporated herein by reference. In this process, oil shale is fed upwardly through a vertical retort by means of a reciprocating piston. The upwardly moving oil shale continuously exchanges heat with a downwardly flowing high-specific-heat, hydrocarbonaceous recycle gas introduced into the top of the retort at about 1200° F. In the upper section of the retort (the pyrolysis zone), the hot recycle gas educes hydrogen and hydrocarbonaceous vapors from the oil shale. In the lower section (the preheating zone), the oil shale is preheated to pyrolysis temperatures by exchanging heat with the mixture of recycle gas and educed hydrocarbonaceous vapors plus hydrogen. Most of the heavier hydrocarbons condense in this lower section and are collected at the bottom of the retort as a product oil. The uncondensed gas is then passed through external condensing or demisting means to obtain additional product oil. The remaining gases are then utilized as a product gas, a recycle gas as hereinbefore described and a fuel gas to heat the recycle gas to the previously specified 1200° F. temperature.

In addition to shale oils, retorting processes also produce a substantially inorganic residue, generally called "spent oil shale". This material usually closely resembles the original raw oil shale in physical size and texture, but is chemically quite different. A significant chemical difference between raw oil shale and spent oil shale (except, of course, for the difference in contained organic matter) is some conversion of carbonates originally present in the oil shale to oxides. This conversion is very low in the lower temperature retorting processes, but can be complete in a high temperature process. Other transformations can occur during retorting to form certain silicate species which are not found in raw oil shales, but these silicates, being fairly inert substances, are not likely to have an effect upon the chemical reactivity of spent shale.

Some oil shale retorting processes cause the formation of a carbonaceous deposit on the surface of the shale particles, which can be combusted to recover otherwise discarded heating values. This combustion step will normally be conducted at temperatures sufficiently high to remove substantially all of the carbonate content from the spent oil shale, forming "decarbonated spent shale". Further, certain of the higher grades of oil shale contain sufficient kerogen for direct burning, omitting any need for retorting. Both decarbonated shale and the residue from direct burning of oil shale, as well as any oil shales which have been heated to a temperature above about 800° F., are considered as spent oil shale for the purpose of the present invention.

In most oil shale retorting processes, arsenic components which may be present in the shale either sublime to or are pyrolyzed into vaporous arsenic-containing components. As a result, arsenic in various forms collects with the educed hydrocarbonaceous vapors and condenses with the higher molecular weight hydrocarbons in the preheated zone or, in some processes, in a condenser situated outside of the retorting vessel. When oil shale from the Green River formation is retorted, the concentration of arsenic in the produced crude shale oil is usually in the range of about 30 to 100 parts per million by weight.

Shale oil can be refined to produce valuable fuels, lubricants and the like, using many of the methods known for petroleum processing, such as catalytic cracking, hydrotreating, hydrocracking, reforming and others. Problems arise, however, due to the irreversible poisoning of expensive catalysts used in such processing, caused by the high arsenic content of the oil.

In addition to causing processing difficulties, the arsenic content limits the usefulness of shale oil even in its unrefined state, since burning an arsenic-containing fuel results in unacceptable pollution. For these reasons, it is desirable to reduce the amount of arsenic present in shale oils to the lowest possible level.

Murray et al. in U.S. Pat. No. 2,779,715, describe an arsenic-removing treatment for hydrocarbons, which requires mixing the hydrocarbon with an alkali metal or alkaline earth oxide, hydroxide, or salt which will have a pH above 7 when dissolved in water. Upon separation of the hydrocarbon, it was found to have a reduced arsenic content.

U.S. Pat. No. 2,867,577 to Urban et al. teaches a method for removing arsenic from hydrocarbons by treating with a nitrogen compound, such as ammonia, hydrazine and amines, and separating a hydrocarbon with reduced arsenic content.

Other arsenic removal methods have utilized solid absorbents, such as nickel and molybdenum components deposited on refractory oxides. Examples of such methods are disclosed in U.S. Pat. Nos. 3,804,750 to Myers et al., 3,876,533 to Myers, and 4,046,674 to Young.

Young, in U.S. Pat. No. 4,075,085, describes a method wherein a hydrocarbon feedstock is mixed with oil-soluble nickel, cobalt or copper-containing additives, heated to at least 300° F., and filtered to remove arsenic. This method has been applied to crude shale oils.

Water is also recovered from the retorting process, usually as a vapor admixed with crude shale oil vapors.

After retort product condensation, this water is normally separated from the oil and treated for disposal or re-use in the process. The water typically contains some arsenic, in an amount which is dependent upon the nature of the retorting process and also the form in which arsenic was present in the original oil shale.

Since arsenic is a notorious pollutant of surface and ground water systems, considerable attention has been given to its removal from industrial and mining wastes. Techniques such as precipitation (e.g., using ferric salts and lime), reverse osmosis and ion exchange have been reported as effective in arsenic removal from mine drainage. Each of these techniques, however, suffers from high costs, either in consumed reagents or in capital equipment.

In view of the high costs of the methods described and the complex nature of most of the methods, a requirement exists for a simple arsenic removal procedure which is applcable to both aqueous and organic fluids, and which does not utilize expensive reagents or equipment.

Accordingly, it is an object of the present invention to provide a simple, inexpensive arsenic removal method.

It is a further object to provide an arsenic removal method which can be used for treating both aqueous and organic fluids.

A still further object is to provide an arsenic removal method which utilizes a waste material from oil shale retorting.

These, and other objects, will appear to those skilled in the art, from consideration of the following description and claims.

SUMMARY OF THE INVENTION

Arsenic removal from aqueous and organic fluids is accomplished by contacting the fluids with spent oil shale and separating therefrom a fluid of reduced arsenic content.

Temperatures above the fluid freezing point can be used for the method of the invention, but arsenic removal is facilitated by elevated temperature, up to about 400° C. A preferred temperature range for organic fluids is between about 250° C. and about 350° C. Superatmospheric pressure, up to about 4,000 p.s.i.a., is preferably used to maintain the fluids in a substantially liquid state during the arsenic removal operation.

DESCRIPTION OF THE INVENTION

It has now been discovered that spent oil shale, such as that withdrawn from an oil shale retort, can be used to remove arsenic from aqueous and organic fluids.

Arsenic removal, in accordance with the present invention, is performed by contacting the arsenic-containing fluid with spent oil shale, that is, the solid, substantially inorganic material resulting from the heating of oil shale. This contact is performed at temperatures above the fluid freezing point, up to about 400° C. Preferred contact temperatures are from about 250° C. to about 350° C., particularly for arsenic removal from organic fluids. Superatmospheric pressure, up to about 4,000 p.s.i.a. is preferably used as necessary to maintain the fluids in a substantially liquid state.

Arsenic removal from organic fluids apparently is enhanced by the presence of water. In the case of shale oil, it has been determined that arsenic is present as arsenic oxide, dispersed in the oil, and as organoarsenic compounds. These organoarsenic compounds are thought to decompose at elevated temperatures, probably most efficiently at temperatures between about 250° C. and about 400° C., forming water soluble arsenic compounds such as arsenic Due to the high solubility of arsenic oxide in water, the transfer of arsenic to an aqueous phase is readily accomplished, and recombination of organic molecules and arsenic can be inhibited by converting the arsenic to a substantially inert form, as by reaction with spent oil shale. While it is not desired to be bound by any particular theory, the foregoing is considered to be a likely mechanism for arsenic removal from organics.

When only inorganic arsenic, e.g., arsenic oxide, is to be removed from fluids, it is not necessary to use such high temperatures in the conduct of the method. Reactions between the spent oil shale and arsenic are facilitated by elevated temperatures, but actually can be conducted at any temperature above the freezing point of the arsenic-containing fluid, assuming, of course, that the fluid viscosity will permit easy handling of the fluid at that temperature.

The present method can be operated under either batch or continuous conditions. For batch operation, the arsenic-containing fluid is intimately contacted with spent shale particles in a suitable vessel, preferably using one of the mixing techniques which are well known in the art. When sufficient arsenic has been removed from the fluid, the phases are separated for recovery of a low arsenic product. For the treatment of organic fluids (such as shale oils, petroleum fluids, and the like) in the presence of water, three phases will normally be found at the conclusion of the method: the organic product, an aqueous phase and the solid spent shale.

Continuous operation can be conducted in a vessel which contains a bed of spent oil shale particles, by simply passing the arsenic-containing fluid through the bed in any desired direction. For organic fluids which are treated in the presence of water, the flow of organic through the bed can be countercurrent to the flow of water in the vessel; water flows downwardly through the spent shale and organic fluid flows upwardly. It is also possible to provide a stationary phase of water in the bed and pass organic fluid upwardly through the shale and water.

The invention is further illustrated by the following examples, which are illustrative of various aspects of the invention and are not intended as limiting the scope of the invention as defined by the appended claims. The term "ppm" is used herein to mean parts per million by weight.

EXAMPLE 1

A reaction bomb is fabricated by boring out a steel cylinder to form a recess which will hold a glass tube of about 300 milliliters capacity. The upper portion of the recess is threaded to accept a plug fitted with a gas inlet tube and valve, so that the bomb can be pressurized and sealed. A well for thermocouple attachment is formed in the metal surrounding the glass tube.

To demonstrate arsenic removal from organic fluids, 40 grams of shale oil are placed in the glass tube of the bomb, with a desired amount of decarbonated spent oil shale and, optionally, water. The bomb is plugged and nitrogen (if used in that particular experiment) is added to obtain the indicated gauge pressure. The sealed bomb is heated to a desired temperature, maintained for an indicated time at that temperature, and then allowed to cool to room temperature before being opened for removal and analysis of the shale oil product. Results are as shown in Table I.

TABLE I

| Test Number | Grams Added Water | Grams Added Shale | Nitrogen p.s.i.g. | Temp. °C. | Time hours | Arsenic, ppm Start | Arsenic, ppm End |
|---|---|---|---|---|---|---|---|
| 1 | 100 | 100 | 100 | 300 | 1 | 40 | 3 |
| 2 | 100 | 20 | 100 | 300 | 1 | 40 | 3 |
| 3 | 0 | 10 | — | 80 | 16 | 69 | 52 |
| 4 | 0 | 10 | 100 | 300 | 4 | 27 | 8 |

EXAMPLE 2

Using the procedure as in the preceding example, 10 grams of decarbonated spent shale are used to demonstrate arsenic removal from aqueous fluids. In each test, 25 milliliters of solution are heated with the shale of 300° C. for one hour. Results are as in Table II.

TABLE II

| Arsenic Solution Compound | Arsenic Solution Solvent | Arsenic, ppm Start | Arsenic, ppm End | Percent Removed |
|---|---|---|---|---|
| $As_2O_3$ | Water | 7,500 | 498 | 93 |
| $As_2O_3$ | Conc. $NH_4OH$ | 10,700 | 92 | 99 |
| $As_2S_3$ | Water | 371 | 147 | 58 |
| $As_2O_3$ | 20% $(NH_4)_2S$ in water | 61,800 | 2,900 | 95 |

Various embodiments and modifications of this invention have been described in the foregoing description and examples, and further modifications will be apparent to those skilled in the art. Such modifications are included within the scope of the invention as defined by the following claims.

What is claimed is:

1. A method for removing arsenic from a substantially liquid hydrocarbon fluid which comprises reacting the arsenic with spent oil shale, by passing the fluid through a bed of spent oil shale particles and separating a fluid having a reduced arsenic content.

2. The method defined in claim 1 wherein the fluid is shale oil.

3. The method defined in claim 1 wherein the fluid is reacted with spent oil shale in the presence of water.

4. The method defined in claim 1 wherein reacting is conducted at a temperature up to about 400° C.

5. The method defined in claim 4 wherein reacting is conducted at a temperature between about 250° C. and about 350° C.

6. The method defined in claim 4, wherein reacting is conducted under a superatmospheric pressure sufficient to maintain the fluid in a substantially liquid state, up to about 4,000 p.s.i.a.

7. A method for removing arsenic from a substantially liquid hydrocarbon fluid which comprises reacting the fluid with spent oil shale, by passing the fluid through a bed of spent oil shale particles at a temperature between the freezing point of the fluid and about 400° C., and at a pressure between atmospheric pressure and about 4,000 p.s.i.a., and separating a fluid having a reduced arsenic content.

8. The method defined in claim 7 wherein the temperature is between about 250° C. and about 350° C.

9. The method defined in claim 7 wherein the fluid is reacted with spent oil shale in the presence of water.

10. A method for removing arsenic from substantially liquid shale oil which comprises reacting the oil with spent oil shale, by passing the oil through a bed of spent oil shale particles at a temperature between about 250° C. and about 350° C., in the presence of water and under a superatmospheric pressure sufficient to maintain the water and oil in a substantially liquid state, up to about 4,000 p.s.i.a., and separating a shale oil having a reduced arsenic content.

* * * * *